US009669843B2

(12) United States Patent
Heaton

(10) Patent No.: US 9,669,843 B2
(45) Date of Patent: Jun. 6, 2017

(54) OVERHEAD RAIL GUIDANCE AND SIGNALING SYSTEM

(71) Applicant: Jeremiah David Heaton, Abingdon, VA (US)

(72) Inventor: Jeremiah David Heaton, Abingdon, VA (US)

( * ) Notice: Subject to any disclaimer, the term of this patent is extended or adjusted under 35 U.S.C. 154(b) by 0 days.

(21) Appl. No.: 15/349,262

(22) Filed: Nov. 11, 2016

(65) Prior Publication Data

US 2017/0057522 A1 Mar. 2, 2017

Related U.S. Application Data

(63) Continuation of application No. 14/457,154, filed on Aug. 12, 2014, now Pat. No. 9,533,691.

(51) Int. Cl.

| | |
|---|---|
| ***B61B 3/00*** | (2006.01) |
| ***B61B 3/02*** | (2006.01) |
| ***B61D 1/04*** | (2006.01) |
| ***B61D 11/00*** | (2006.01) |
| ***E21F 11/00*** | (2006.01) |
| ***E21F 13/00*** | (2006.01) |
| ***B61L 5/12*** | (2006.01) |

(52) U.S. Cl.

CPC ..... *B61B 3/02* (2013.01); *B61D 1/04* (2013.01); *B61D 11/00* (2013.01); *B61L 5/12* (2013.01); *E21F 11/00* (2013.01); *E21F 13/004* (2013.01)

(58) Field of Classification Search

CPC . B61B 3/00; B61D 11/00; B61L 5/125; B61L 23/002; E21F 11/00; E21F 13/004; G09F 7/00; G09F 7/18

See application file for complete search history.

(56) References Cited

U.S. PATENT DOCUMENTS

| | | | | | |
|---|---|---|---|---|---|
| 3,920,115 | A | * | 11/1975 | Craggs | B65G 41/02 198/812 |
| 4,102,550 | A | * | 7/1978 | Campbell | E21C 35/20 198/861.2 |
| 4,179,160 | A | * | 12/1979 | Sabo | A62B 3/00 116/202 |
| 4,267,778 | A | * | 5/1981 | Wilkie | B65G 17/20 104/94 |
| 5,044,696 | A | * | 9/1991 | Blackhurst | B28D 1/045 125/14 |
| 5,495,808 | A | * | 3/1996 | Wegrecki | E01B 25/24 104/111 |

(Continued)

*Primary Examiner* — Jason C Smith

(74) *Attorney, Agent, or Firm* — Luedeka Neely Group, P.C.

(57) ABSTRACT

An overhead railway and trolley for transporting miners out of a mine. The railway is formed by connected rails that are mounted to a roof of a mine. The trolley is mounted to a bottom flange of the rails and includes wheel assemblies having at least two wheels mounted side-by-side, and each is configured to engage and roll along a top surface of the bottom flange. The trolley has a clicker that is configured to engage protrusions extending away from the bottom flange. The clicker permits the trolley to travel out of the mine but prevents it from traveling into the mine. The trolley also includes a pair of handles that are configured to be gripped by a miner standing on a floor of the mine as he travels from the beginning of the railway to the ending (i.e., the egress direction).

8 Claims, 17 Drawing Sheets

(56) References Cited

U.S. PATENT DOCUMENTS 5,524,548 A * 6/1996 Fox ..... B61H 7/00 104/249
6,058,849 A * 5/2000 Ostholt ..... B66C 7/04 104/139
6,073,575 A * 6/2000 Wotherspoon ..... A62B 3/00 116/205
6,324,989 B1 * 12/2001 Taylor ..... B61B 3/02 104/106
6,412,757 B1 * 7/2002 Ohno ..... F16F 7/00 104/172.4
6,457,418 B1 * 10/2002 Persson ..... B61B 13/125 104/166
7,207,633 B2 * 4/2007 Wittenberg ..... E21C 37/22 173/133
7,513,463 B2 * 4/2009 Rossmann ..... B61B 13/04 180/168
7,856,930 B2 * 12/2010 Zaguroli, Jr. ..... B66C 9/14 104/89
7,926,640 B2 * 4/2011 Fuchs ..... B65G 15/08 198/313
8,002,083 B2 * 8/2011 McLoughlin ..... A62B 3/00 182/100
8,191,481 B2 * 6/2012 Spangler ..... B65G 43/10 104/166
8,333,420 B2 * 12/2012 Mehl ..... B60N 2/24 296/63
8,414,026 B1 * 4/2013 Lou ..... B64D 25/06 280/804
8,683,924 B1 * 4/2014 Hutchinson ..... B61B 3/00 104/89
8,820,499 B2 * 9/2014 Wells, Sr. ..... H02G 1/06 104/89
8,875,636 B2 * 11/2014 Kempf ..... F16H 19/06 104/89
9,353,601 B2 * 5/2016 Hause ..... E21B 41/00
2002/0152921 A1 * 10/2002 Hudson ..... B61K 7/16 104/95
2005/0183620 A1 * 8/2005 Kawato ..... B61B 3/00 104/89
2006/0156944 A1 * 7/2006 Vetesnik ..... A62B 35/0056 104/89
2007/0245946 A1 * 10/2007 Smith ..... A62B 3/00 116/205
2008/0028516 A1 * 2/2008 Morishima ..... A61G 7/1051 5/89.1
2008/0066640 A1 * 3/2008 Hutchinson ..... E21F 17/02 104/89
2015/0047528 A1 * 2/2015 Heaton ..... B61L 5/125 104/89

* cited by examiner

OVERHEAD RAIL GUIDANCE AND SIGNALING SYSTEM

CROSS-REFERENCE TO RELATED APPLICATION

This application is a continuation of application Ser. No. 14/457,154, filed Aug. 12, 2014, which is incorporated herein by reference in its entirety.

FIELD

This invention relates to the field of mine safety. In particular, this invention relates to an overhead rail and trolley used by miners to quickly escape from a mine in emergency situations.

BACKGROUND AND SUMMARY

In mining environments, escape line systems constructed from ropes or cables have been suspended from the roof of the mines. The purpose of the safety line is to assist miners in escaping from the mine or for rescue personnel to enter the mine in the event that there is a fire, flood, etc., where visibility is limited. Referring now to the drawings, FIG. 1 depicts the current state-of-the-art mining "escape line" system that is standard throughout the mining industry.

The system consists essentially of an escape line that is made from a rope, string and/or cable that is suspended from the roof of the mine. To use the system, miners grab onto the escape line using their hands and walk towards the exit of the mine. At each of the suspension points, miners remove their hands from the escape line and then grab the line on the other side of the suspension point. Indicators are placed at intervals along the length of the rope which provide miners with a visual and tactile reference point or warning. The indicators may be used to indicate the direction that the miner is traveling. For example, certain indicators are arrow-shaped and the arrow points towards the exit of the mine. Similarly, the indicators may include reflectors, such as green and red reflectors, to indicate that miner is exiting or entering the mine. The indicators may also be used to indicate that a particular location has been reached. For example, it is often understood that consecutive orb-shaped indicators are placed near a branching location where the escape line branches in two or more directions.

This system has, thus far, been a relatively effective means for assisting miners to escape mines when needed. However, there are many areas where the system could be improved. For example, since this system is typically employed in mines and is typically only used during or after a triggering event, the condition of the mine and the miners are typically not well suited for making a quick, safe and organized escape from the mine. Rather, the mine is often dark and the miners have limited vision and may have sustained injuries. The miners' exit is slowed and made more dangerous since they are required to grasp the escape line by hand and because they have to then remove their hands from the line at each suspension point and reflectors.

What is needed, therefore, is an improved escape system for miner egress that overcomes the problems associated with today's escape line systems.

The above and other needs are met by a guidance and signaling system that includes an overhead railway in which one direction along the railway is defined as an ingress direction and an opposite direction along the railway is defined as an egress direction. A protrusion is located on the overhead railway. A trolley is mounted to and configured to move along the overhead railway. The trolley includes a protrusion engaging member that is configured to engage the protrusion of the railway. The protrusion engaging member may be used to selectively prevent the trolley from moving in the ingress direction. The protrusion engaging member moves between a first position where the trolley can be moved past the protrusion in either the ingress direction or the egress direction and a second position where the trolley can be moved past the protrusion in the egress direction only and is stopped by the protrusion when moving in the ingress direction.

In certain cases, a gripping member is located on the trolley that is configured to be gripped by a user to enable the user to move the trolley along the railway. The system may include a plurality of consecutive protrusions disposed along the length of the railway configured to engage with the protrusion engaging member. In certain cases, the overhead railway is formed by a plurality of rails joined end to end to form an intersection and wherein a protrusion is located at each intersection between rails. In certain cases, the protrusion engaging member is biased to the second position by a biasing member so that, by default, the trolley can be moved past the protrusion in the egress direction only and is stopped by the protrusion when moving in the ingress direction. The system may further include a biasing member override that may be used to move the protrusion engaging member from the second position to the first position so that the trolley can be moved past the protrusion in either the ingress direction or the egress direction.

In certain cases, a rescue seat is provided that is configured for suspension from the trolley. The seat includes a seat body having a seat portion and a back portion, one or more adjustable straps having connector ends configured to mount to the trolley and configured to hang beneath the railway, and sleeves in both the seat and back portions configured to receive and position the one or more straps and configured to support a miner seated in the seat.

In certain cases, a passenger board is provided that has a plurality of notches formed therein. The notches in the passenger board are configured to receive one or more straps suspended from the trolley. The one or more straps are configured to support the passenger board in a substantially horizontal orientation.

BRIEF DESCRIPTION OF THE DRAWINGS

Further advantages of various embodiments are apparent by reference to the detailed description when considered in conjunction with the figures, which are not to scale so as to more clearly show the details, wherein like reference numbers indicate like elements throughout the several views, and wherein.

DETAILED DESCRIPTION

The following disclosure relates to an improved overhead rail guidance and signaling system for improving worker safety in mines. As used herein, the term "mine" refers generally to any space where humans may become trapped due to changing conditions, including through power outages, fire, smokes, injured worker, and the like. In addition to mines, the term may refer to caves, warehouses, factories, subways, attics, basements, and the like. Similarly, the term "miner" may be used throughout this disclosure to refer generally to anyone located in a "mine." Finally, throughout this disclosure, the term "triggering event" is used to refer to any such event that would cause the system to be used.

Figure 1:
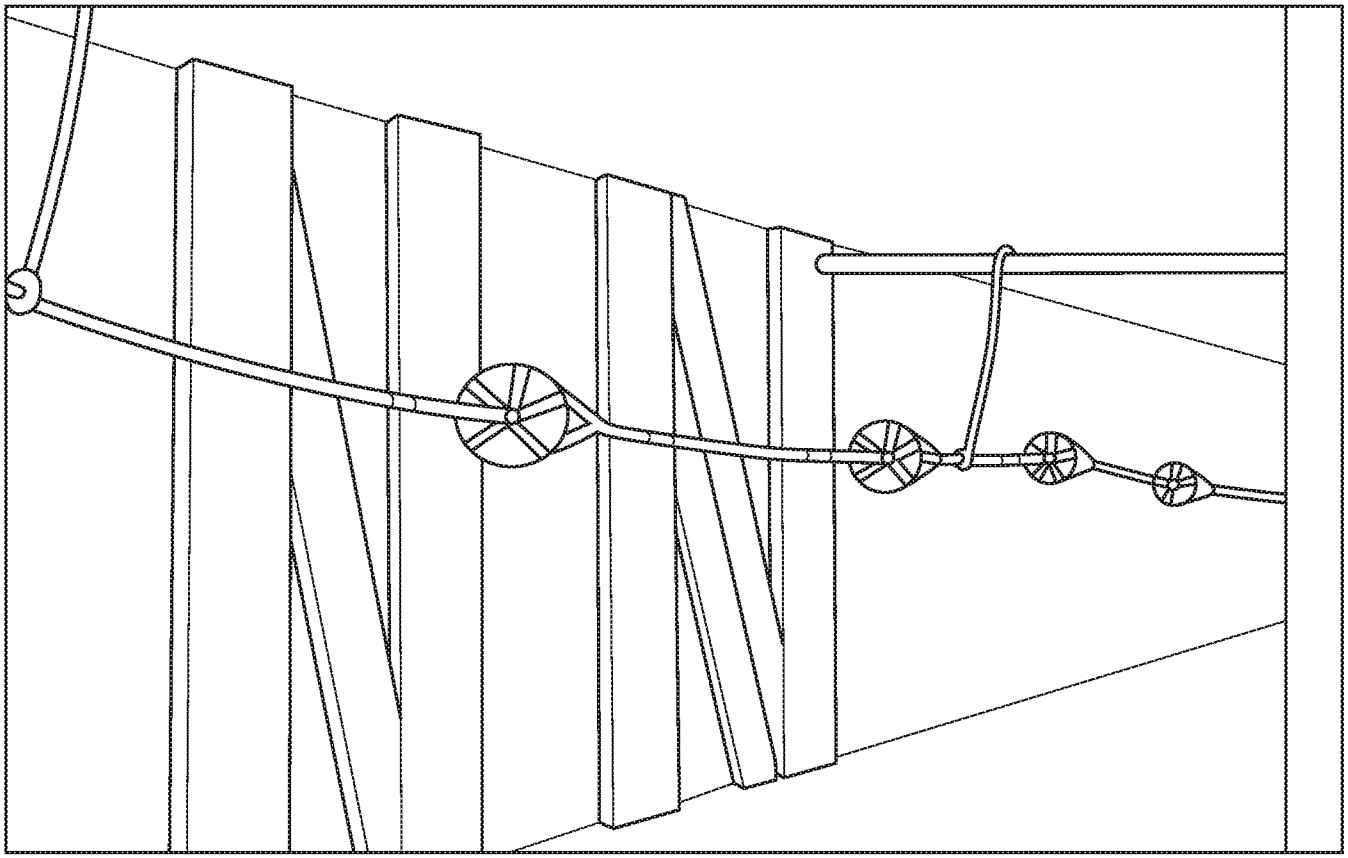
FIG. 1 Prior Art
FIG. 1 depicts an example of a historic escape line system used in mines.
Figure 2:
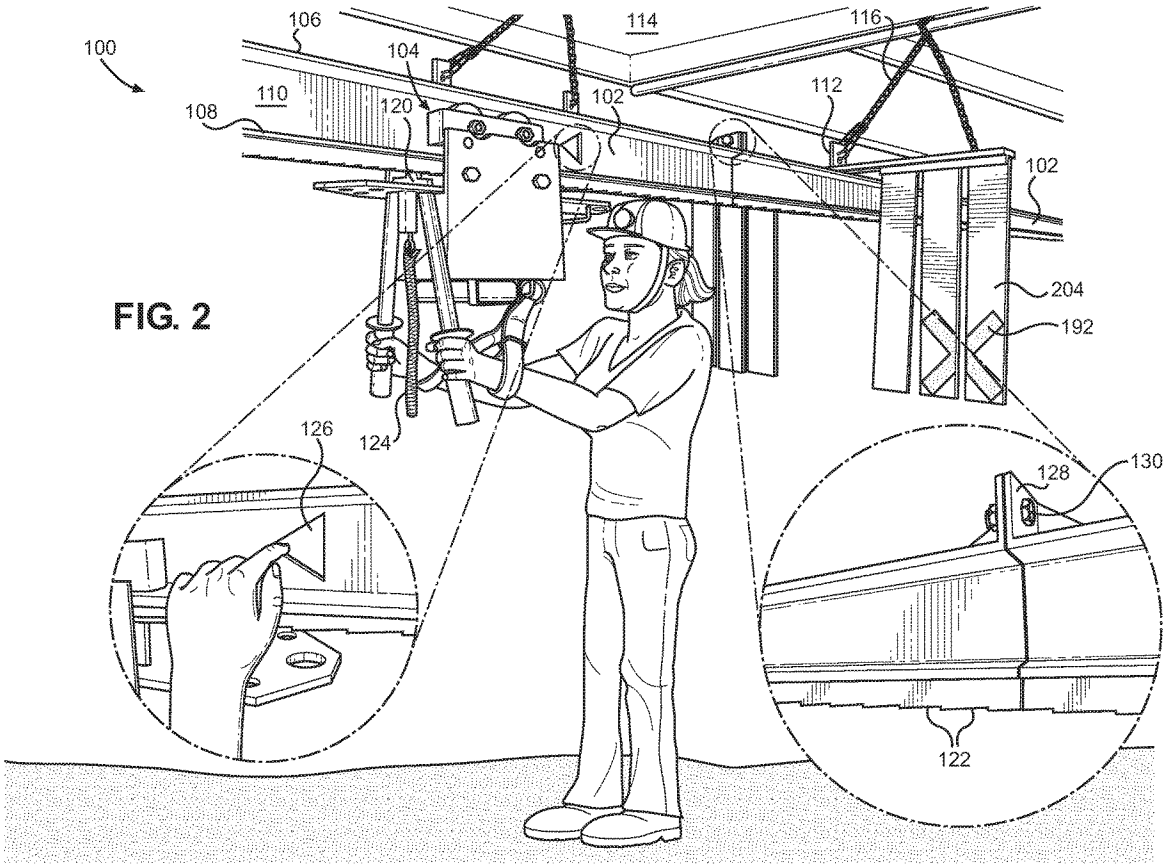
FIG. 2 depicts various aspects of an overhead rail guidance and signaling system according to an embodiment of the present invention.
Figure 3:
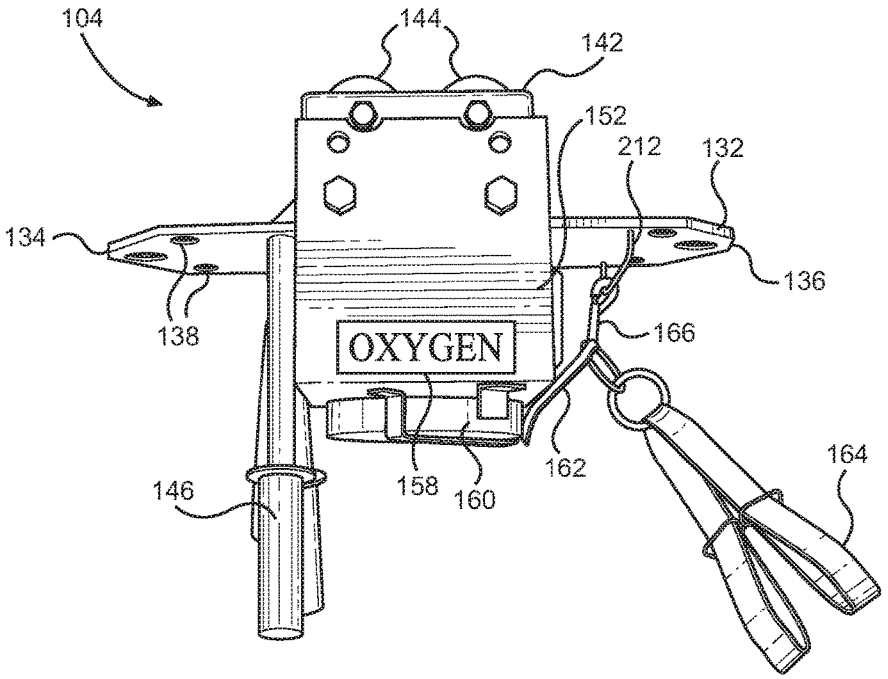
FIGS. 3-6 provide side and top views of the trolley shown in FIG. 1.
Figure 4:
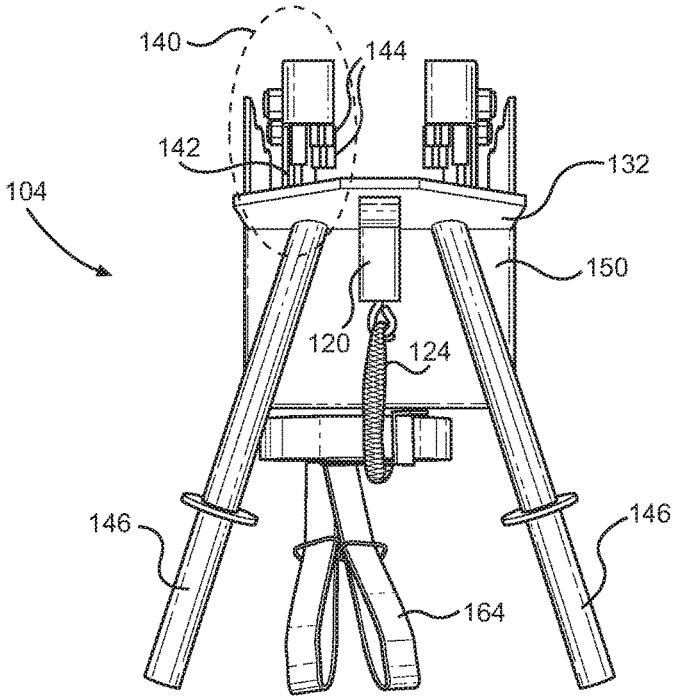
Figure 5:
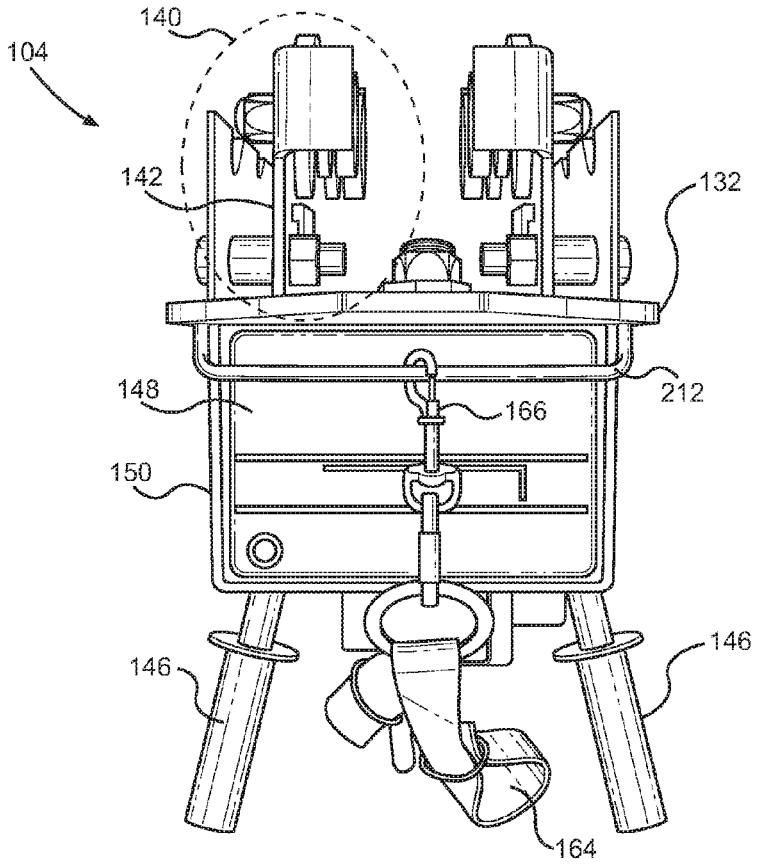
Figure 6:
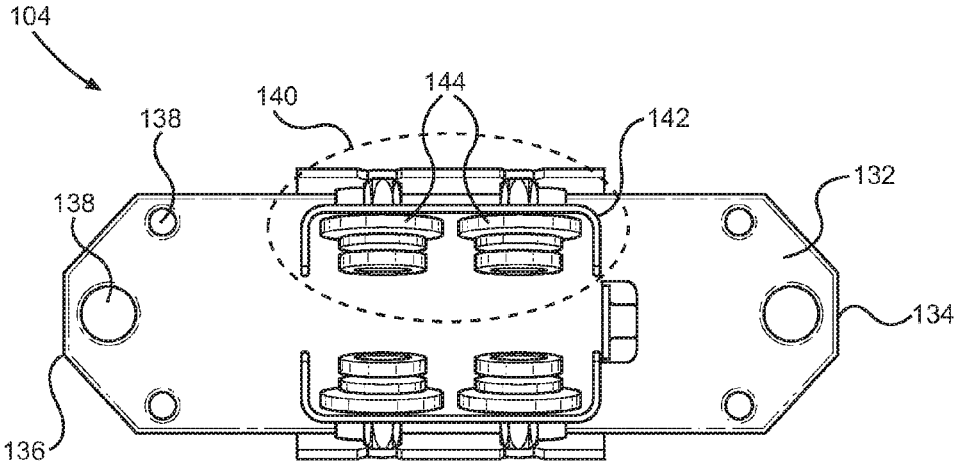

The overhead rail guidance and signaling system of the present disclosure overcomes each of the problems of the aforementioned escape line system. With reference now to FIG. 2, this rail system 100 includes generally a rigid system of interconnected railways constructed from a plurality of rails 102 that are suspended over the floor of the mine to form an escape rail line. Additionally, a trolley 104 is mounted to the bottom of the rails and is grasped by the miner. Unlike the previously described escape line system, when using this rail system 100, the miner is physically connected to at least one component of the rail system at all times and is never disconnected from the system. For example, a tether system allows miners to explore areas adjacent the rail line. Ideally, there is at least one trolley 104 for each miner that is located within a given area of the mine.

The rail system 100 enables miners to safely and quickly egress from mines when dangerous conditions are present and provides both visual and tactile indicators that are designed to signal areas of importance, such as refuge, first aid and oxygen storage areas that are placed along the escape rail line. As discussed in detail below, miners using the rail system 100 will have access to onboard oxygen and the trolley 104 may be reconfigured to carry injured miners. Highly visible and reflective materials are used on the various components of the system to enable easy visual detection and identification of the components. For example, the various components are preferably covered with a fully reflective paint coating. Also, a variety of colors may be used to convey information to the miners. Several key features of this system 100 are related to providing the miner with redundant visual, auditory and tactile feedback. Providing information to miners in a number of ways is particularly important in this case because mines are often loud and dark auditory signals or visual signals, alone, may be missed by miners.

The railways are constructed as mining work takes place and may include a number of branching pathways that originate from the entrance/exit of the mine and branch out to each working section. The rails 102 may be made from standard structural beams, such as I-beams, H-beams, S-beams, etc., and may be provided in a variety of lengths and shapes. For example, rails 102 may be provided in lengths of about 5 feet to about 30 feet. Additionally, rails 102 may include straight rail sections, left and right turning sections, each having a turn radius of about 5 degrees to about 90 degrees, and upwards and downwards arching sections, each having a turn radius of about 5 degrees to about 90 degrees. The number, size and shape of rails 102 required will depend on the location and the condition of the mine. According, each railway will be customized according to mine conditions.

In general, the rails have a top flange 106 and a bottom flange 108 that are substantially horizontal and a vertical webbing 110 that connects the top and bottle flanges. The trolley 104 is suspended from the bottom flange 108 and is grasped by the miner, who walks underneath the rail 102. Rails 102 may be composed of steel, aluminum, fiberglass, carbon fiber, stainless steel, plastic, or other similar materials. Each rail section 102 has two or more attachment points 112 disposed on the top flange 106 that enable the rail section to be suspended from the roof 114 of the mine by roof hangers 116 (e.g., chains, cables or the like). When using this system, miners always travel underneath the rails 102 in order to protect the miners' heads from contact with the mine ceiling.

One or more tabs or protrusions 122 may be disposed on the bottom flange 108 of the rails. Preferably, the protrusions 122 extend away from the bottom of the bottom flange 108 and are sized such that the trolley 104 can roll past them. The protrusions 122 are designed to interact with a clicker 120 that is located on the trolley 104. The clicker 120 is preferably a spring-loaded member that clicks over the protrusions 122 provides auditory feedback to the miner as the trolley travels along the railway. Additionally, certain "gateway" rail sections include extended areas of many protrusions 122 that extend downwards from the bottom flange 108. These areas function in a similar manner as the protrusions 122 discussed above by interacting with the trolley clicker. The protrusions 122 create a continual clicking sound and vibrating motion that may be used to alert the miner. For example, protrusions 122 may be located near a dangerous mine condition or near another point of interest, such as a refuge area.

In addition to providing sound motion feedback, the protrusions 122 may also restrict the motion of the trolley 104 along the rail 102 such that the trolley is only permitted to travel in one direction but not in the other direction. This ensures that a miner does not become disoriented and begin traveling in the opposite direction (i.e., back into the mine) unintentionally. In the event that the miner needs to travel in the opposite direction, the trolley 104 may be equipped with a clicker release 124. Activating the release 124 holds the clicker 120 away from the protrusions 122 so that the trolley rolls freely in either direction. For example, in the embodiment shown, the release is simply a cable that is connected to the clicker 120. By pulling the cable, the clicker 120 is disengaged from the protrusions 122. In preferable embodiments, the clicker release 124 may be selectively locked in an activated or deactivated position. This feature is particular useful for enabling the trolley 104 to be initially moved into a ready position near the miners' work area or to be moved further into the mine as necessary. In this way, the miner is not required to continually engage the release 124. To further assist the miners in orienting themselves and to avoid inadvertently traveling in the wrong direction, the rails 102 may include one or more directional arrow cutouts 126. These cutouts 126 may be located in either the webbing 110 or the top or bottom flanges 106, 108 of the rail 102 to indicate the proper direction of travel.

Connection points 128 disposed on the top flange and at both ends of the rail 102 enable the rails to be fixedly connected together. Preferably, the connection points consist of an upwardly extending tab that is configured to mate with a corresponding tab on adjacent rails. Each of the tabs 128 has one or more apertures that are sized to receive a bolt 130 therethrough so that adjacent rails 102 may be bolted together.

With reference to FIGS. 3-6, the trolley 104 is a wheeled cart that is grasped by a miner during an evacuation and is rolled along the bottom flange 108 of the railway to the exit of the mine. The trolley 104 includes a base plate 132 that has a front end 134 and a back end 136 and that is positioned below the bottom flange 108 of the rails 102 when the trolley is in use. A plurality of first openings 138 of various sizes, including small and large openings, may be formed in either the front or back end 134, 136 of the trolley 104. As discussed in greater detail below, one purpose of the first openings 138 is to enable additional components to be removably clipped to the trolley 104.

Two identical wheel assemblies 140 are mounted on either side of the base plate 132. Each wheel assembly 140 includes a wheel mounting plate 142 that extends vertically upwards from the top surface of the base plate 132. The wheel assembly 140 includes at least two wheels 144 that are mounted side-by-side to the mounting plate 142 to provide a stable rolling surface. However, in certain embodiments, the wheel assembly 140 may include additional wheels 144. The wheels 144 are positioned on the mounting plate 142 such that they roll over the top surface of the bottom flange 108 and the base plate passes under the bottom surface of the bottom flange as the trolley 104 is moved along the rail 102. The trolley 104 may be pushed by grasping the pair of handles 146 extending downwards from the front end 134 of the base plate 132. Preferably, the ends of the handles 146 are provided with grips that are well suited for gripping, such as rubber or silicone grips.

During a triggering event, the lack of oxygen is a common danger for miners. Accordingly, each trolley 104 is preferably provided with a supply of supplemental oxygen 148. Supplemental oxygen 148 may be provided in the form of an oxygen tank or as a self-contained self-rescue device. The trolley 104 includes an oxygen storage box 150 for storing the supplemental oxygen 148. The storage box 150 may be used to store additional useful components. For example, blankets, tarps, first aid equipment, straps, flashlight, etc. may also be placed into the storage box. Since the storage box 150 may be provided with a number of useful items, it may be beneficial to provide the storage box 150 as a kit. Accordingly, in certain embodiments, the storage box 150 is a detachable kit that may be quickly removed or secured to the trolley 104. For example, the storage box 150 may be magnetically connected to the base plate 132. In another example, the storage box 150 is connected by mating bolts into slotted receiver openings.

Preferably, the storage box 150 is mounted behind the handles 146 and has an open end 152 that faces towards the miner when the miner is facing the front end 134 of the trolley 104. As such, the supplemental oxygen 148 maybe removed quickly and easily by the miner while holding on to the handles 146. Preferably the storage box 150 includes padding in order to protect the supplemental oxygen 148 and to provide a snug fit. In certain embodiments, the storage box 150 may be equipped with a guard that assists in preventing the supplemental oxygen 148 from inadvertently falling out of the box and being damaged. The guard may include, for example, a strap that extends across the open end 152 of the storage box 150. The guard may comprise a door that is mounted over the open end 152. Finally, to assist miners in quickly identifying a trolley 104 equipped with supplemental oxygen 148, an "OXYGEN" sign 158 may be provided on the trolley. Preferably the oxygen sign 158 is located on an outer surface of either the wheel mounting plate 142 or the storage box 150 and comprises a highly reflective and highly visible material.

Another common problem that occurs during a triggering event is that the miners may become disoriented during the process of traveling out of the mine. While disoriented, miners may become separated from the other miners and from the escape line. Also, miners may inadvertently travel in the wrong direction, such as back into the mine towards dangerous conditions. The current system employs a number of safety mechanisms that are designed to assist the miner avoid becoming disoriented or from being separated from the railway. First, as mentioned above, the trolley 104 includes a clicker 120 that works cooperatively with tabs located at the junction of two rail sections 102 and also with saw tooth protrusions 122 that are located at certain key areas of the railway. The spring-loaded clicker 120 clicks over the protrusions 122 in only one direction and cannot travel in the opposite direction. Accordingly, since the cocker can only travel in one direction (i.e., out of the mine), they are prevented from inadvertently traveling back into the mine. The only way that the trolley 104 can travel in the opposite direction is when the miner makes a conscious effort to engage the clicker release 124.

To assist the miner from becoming separated from the railway, the trolley 104 may be equipped with a retractable tether system 160. The tether system 160 is comprised of a retractable coil or cable 162, such as a metal or fabric cable, which is fixedly mounted to an exterior surface of the oxygen storage box 150. The end of the retractable cable 162 includes a pair of adjustable straps 164 that are configured for placement around wrist or forearm of the miner and that may be adjusted according to the size of the miner. To ensure the miner's safety, the straps 164 should remain connected to the miner for the entire duration that he is using the trolley while exiting the mine.

A clasp 166 is connected to the end of the retractable cable 162. The clasp 166 is designed to attach and detach from one or more of the first openings 138 located in the base plate 132 or to tether clip 212 located on the bottom of the base plate 132. This tether clip 212 may be located sufficiently close enough to the aforedescribed oxygen storage box 150 that clipping the cable 162 to the clip secured the contents of the storage box. Preferably, the straps 164 are connected to the miner during the entire time the miner is exiting the mine or using the trolley 104 and the clasp is connected to the tether clip 212. In addition to the handles 146, the straps 164 provide additional support to assist in preventing the miner from falling or from becoming detached from the trolley 104, especially if the clasp has been connected to the tether clip 212.

The clasp 166 can be detached from base plate 132, thereby allowing the miner to walk away from trolley 104 while still remaining attached via retractable cable 162. This may be beneficial, for example, if the miner needs to assist a fellow miner. Also, as detailed below, the miner may need to explore certain gateway areas in order to access certain rescue components. The retractable tether 160 enables the miner to explore these areas without risking becoming separated from the railway or the trolley 104.

Figure 7:
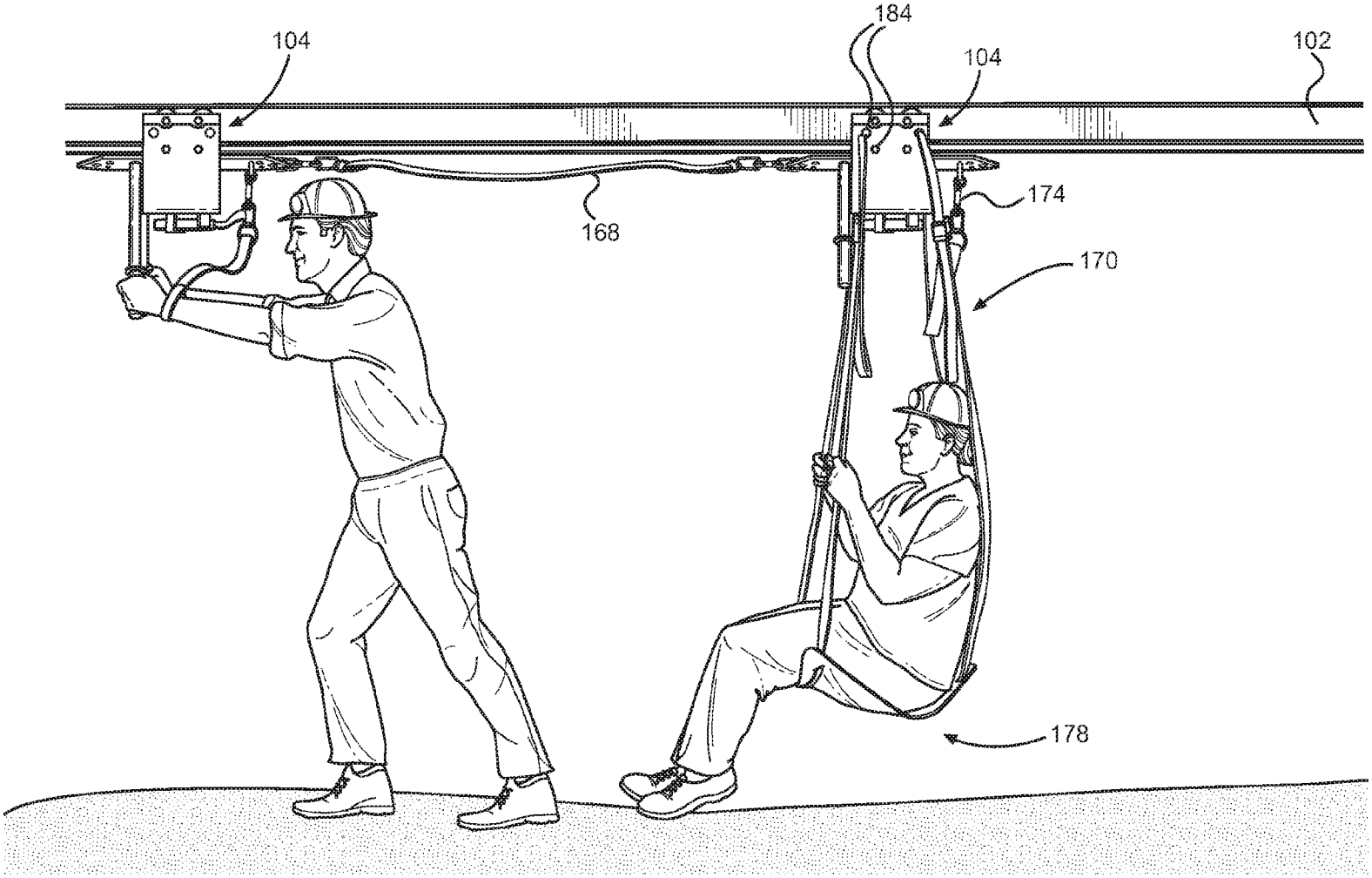
FIG. 7 depicts two trollies connected together using a rescue strap and an injured miner seated in a rescue seat.

As shown in FIG. 7, the system 100 may include a buddy rescue strap 168, a multi-purpose strap made of metal cable and/or fabric having clips at both ends thereof. The rescue strap 168 may be connected between a miner, who is positively connected to the trolley 104 via the retractable cable 162, and another miner, who is not connected to the trolley. The rescue strap 168 may be used, for example, in the event that there is an injured miner. Similarly, if there are an insufficient number of trolleys to accommodate the number of miners located in the mine. Alternatively, the rescue strap 168 may be connected to the first openings 138 in the base plate 132. This may be used, for example, to connect a miner to the trolley 104. In another example, a rescue strap 168 may be connected to first openings 138 of adjacent trolleys 104 in order to connect the two trolleys together. One or more rescue straps 168 are preferably stored in the storage box 150 along with the supplemental oxygen 148.

Figure 8:
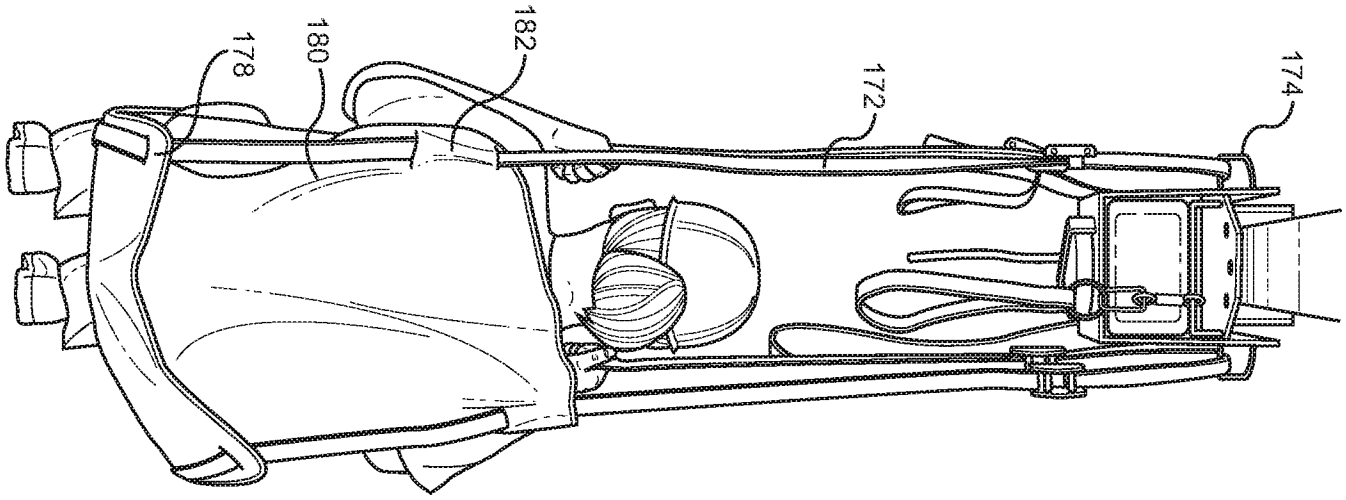
FIG. 8 is a rear view of the rescue seat shown in FIG. 7.
Figure 9:
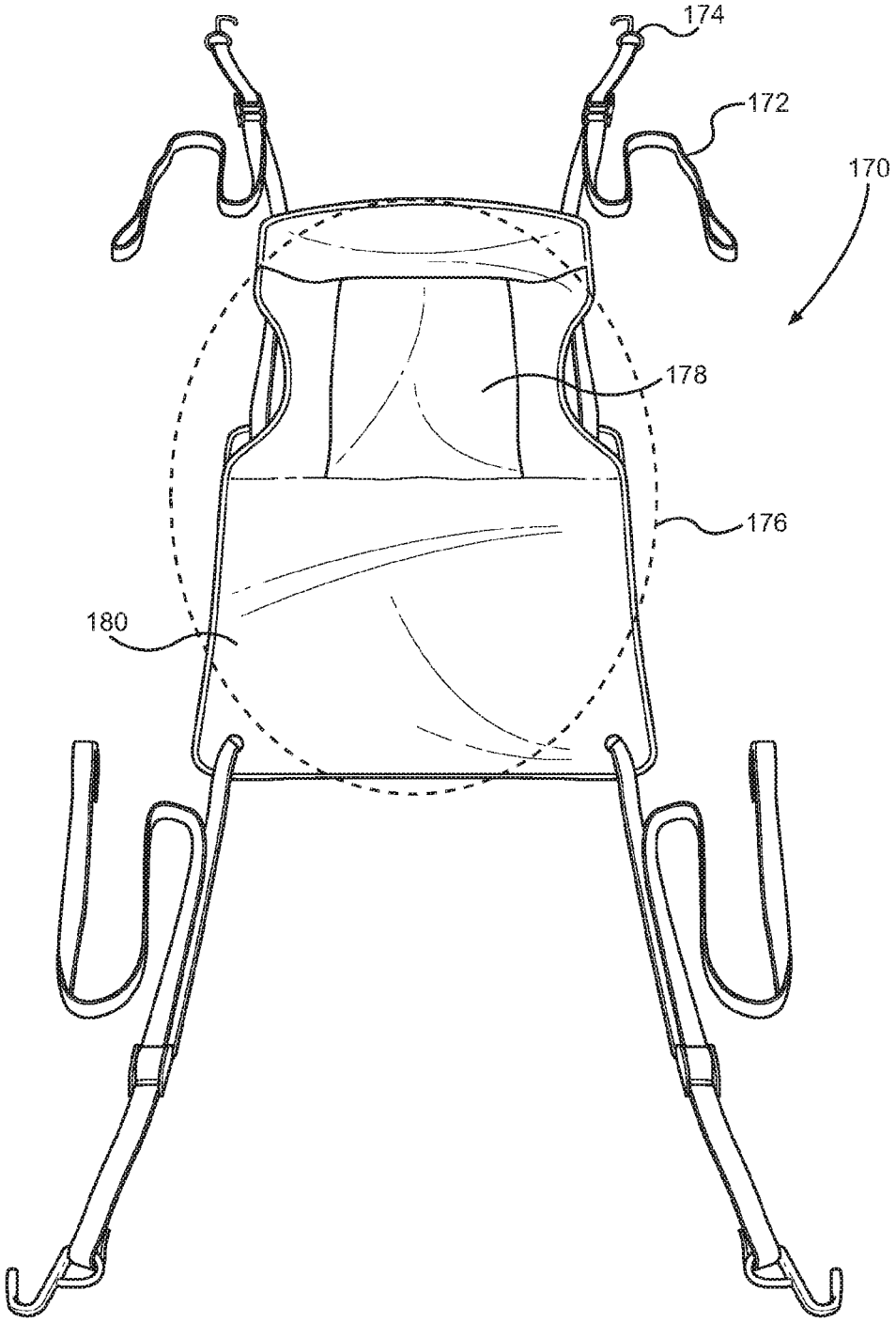
FIG. 9 depicts a rescue seat according to an embodiment of the present invention.

With reference to FIGS. 7-9, the system 100 further includes a rescue seat 170, a multi-purpose seat designed to be suspended from bottom of the trolley 104 and to be used to transport miners in a variety of configurations. The seat 170 consists of heavy-duty cables or straps 172 having connectors 174, such as hooks or bolts, attached at each end. A seat body 176 is formed from heavy-duty fabric and includes a seat portion 178 and a back portion 180. A number of sleeves 182 are formed in both the seat and back portions 178, 180 of the seat body 176. The straps 172 are inserted through the sleeves 182 to form a support structure for the seat body 176. The connectors 174 are mounted to various attachment points located in the trolley 104. For example, the connectors 174 may be connected to the first openings 138 in the base plate 132 or to second openings 184 formed in the mounting plates 142. The rescue seat 170 is preferably stored in the storage box 150 along with the supplemental oxygen 148.

Figure 10:
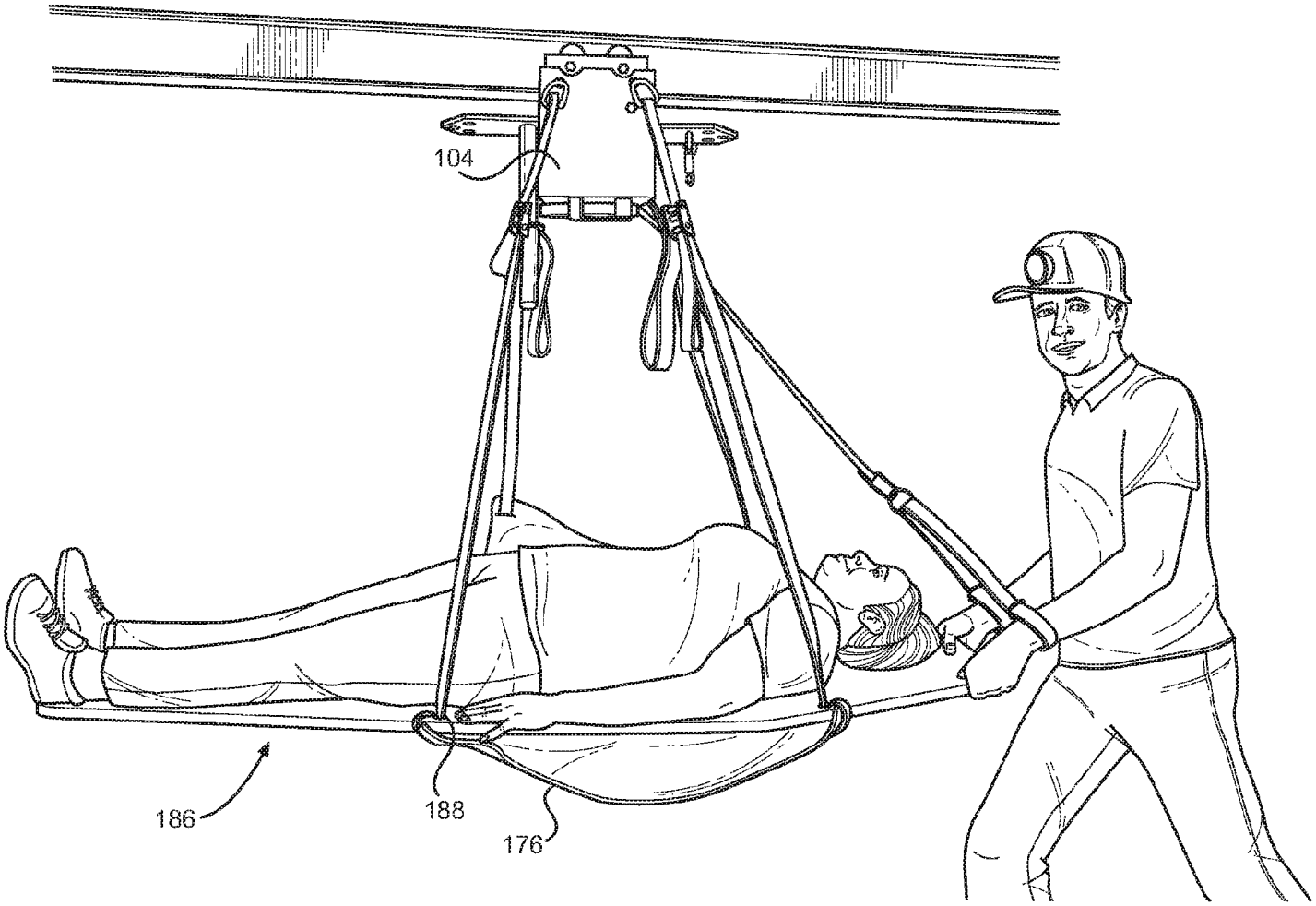
FIG. 10 depicts an injured miner being transported on one type of passenger board suspended from the overhead rail.

The straps 172 of the seat 170 may be adjusted to accommodate miners having different body types and also to accommodate mines having differing heights. The straps 172 may also be adjusted in order to receive various types of stretcher-type platforms. For example, as shown in FIG. 10, a passenger board 186 may be laid across the seat body 176. The board 186 may include a number of notches or holes 188 designed to receive the straps 172 of the rescue seat 170 and to hold the board in a substantially horizontal orientation. Preferably, the passenger board 186 is foldable and may be stored on the trolley 104.

In certain embodiments, the board 186 is sized to replicate a stretcher in order to transport injured miners to safety. In this configuration, the rescue seat 170 is removed from the storage box 150 and the straps 172 are connected to the trolley 104 by mating the connectors 174 with the first or second openings 138, 184. The straps 172 are then adjusted to ensure a flat surface. The passenger board 186 containing the injured miner is then placed onto the flat surface and the straps 172 are inserted into the notches 188. The straps 172 may be adjusted as needed to ensure that the passenger board 186 remains flat and clears the bottom surface of the mine floor. Alternatively, the straps 172 may be inserted through the holes 188 and then the passenger is placed onto the passenger board 186. When using the rescue seat 170 alone or with the passenger board 186 to transport an injured miner, the trolley 104 holding the injured miner can be pushed by another miner or pulled by another miner using a rescue strap 168. The strap 168 may be connected trolley-to-trolley, trolley-to-rescuing miner, or rescuing miner-to-injured miner. Additionally, the trolley 104 holding the injured miner may be pushed ahead of another miner's trolley.

Figure 11:
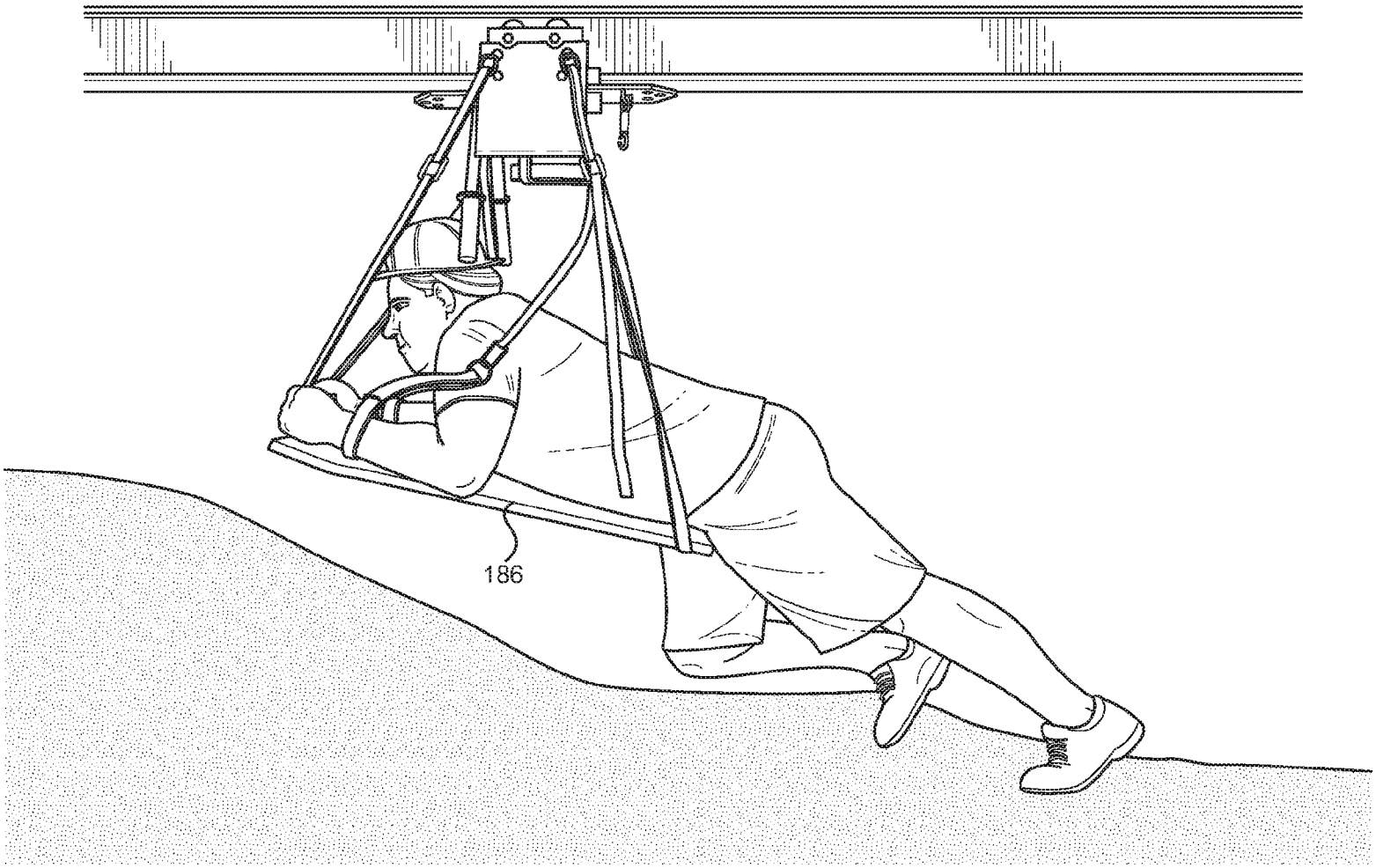
FIG. 11 depicts a miner on another type of passenger board in a low-ceiling mine.

Sometimes, the passenger board 186 may be used to assist uninjured miners in traversing mines having low ceilings. As shown in FIG. 11, to improve its mobility, the low-ceiling passenger board 186 may be shorter in length than a standard stretcher that is used for injured miners. When using the low ceiling passenger board 186, a miner may lay chest down onto the board and then kick his legs behind him to propel the trolley 104 forward. As with the high ceiling method of use discussed above, the miner preferably places his arms through the adjustable straps 164 of the retractable tether system 160 in order to provide continual positive connection with the system 100.

Figure 12:
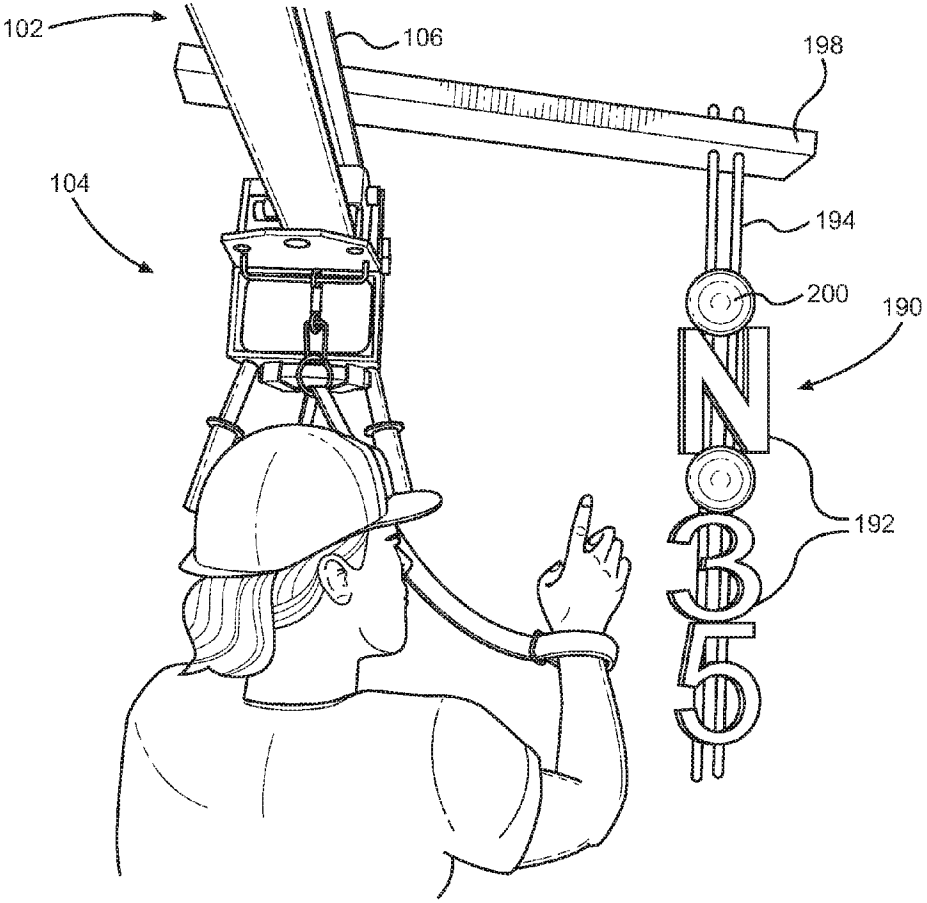
FIGS. 12 and 13 illustrates a miner interacting with two types of informational signs.

As the miner travels along the railway using the trolley 104, he will periodically encounter various informational signs that are designed to provide information, such as the locations of a mandoor along the escape path or the location of a refuge, or warnings. Similarly, these signs may indicate the presence and location of a break in the railway, the heading and location of the miner, or the miner's exact location. This information would be helpful, for example, in assisting rescue personnel in locating the miner and for orienting the miner. These signs are spaced at intervals determined by law or by other policies, such as company policy. As shown in FIG. 12, one example of an informational sign 190 provides visual and tactile information to miner. The sign 190 is preferably composed of steel, aluminum, fiberglass, carbon fiber, stainless steel or plastic. Preferably, the surfaces of the sign 190 comprise a reflective, highly visible material. The rail 102 may be provided with a number of protrusions 122 that interact with the clicker 120 to alert the miner to the presence of an approaching or nearby sign 190.

The sign 190 is preferably suspended from a portion of a rail 102 so that it is highly visible and is also within the reach of the miner. However, the sign 190 is preferably spaced far enough away from the rail 102 that the miner can run past the sign without interference. In preferred embodiments, the sign 190 is suspended 12-24 inches away from a rail center line located in the middle of the railway. In the case of low visibility, it is important that the sign 190 be within the miner's reach so that the miner can reach and touch the various portions of the sign to understand the information it provides through touch alone.

In the example shown, the sign 190 includes a number of characters 192 that are placed onto cables 194. In this particular example, the characters 192 comprise three-dimensional objects in the shape of letters, numbers, objects, etc. However, in general, the term "characters" may be used to refer to any informational indicia placed on the signs 190. Once the characters 192 are secured to the cables 194, the cables are suspended from a sign hanger 198. The sign hanger 198 is a rigid member that is preferably bolted to the top flange 106 of the rail 102 and may extend to either the right or left side of the railway.

The characters 192 are placed onto the cables 194 in a particular order to provide the miner with particular information. The type of information may change based on the shape and orientation of the characters. The characters 192 may include a number of information breaks 200 that separate sets of characters 192 providing certain portions of information from other sets of characters providing other portions of information. In this particular example, the sign 190 shown indicates the presence of a nearby mandoor. The first or top information break 200 indicates that the first piece of information is below. In this example, the top character 192 is an indication of the miner's heading or beltline. Here, the "N" may indicate that the miner is heading North or that the miner is in the N beltline. Other numbers or letters could be used to indicate other headings or locations within the mine. A second information break 200 indicates that the first piece of information is concluded and the second piece of information is below. In this case, the bottom characters 192 provide an indication of the distance to the relevant location. For example, the character may indicate the number of feet/meters, the number of rails (which may be easily counted by the clicks between rails), etc. While, in this particular, example, two sets of characters are provided, more or less may be provided as needed.

Figure 13:
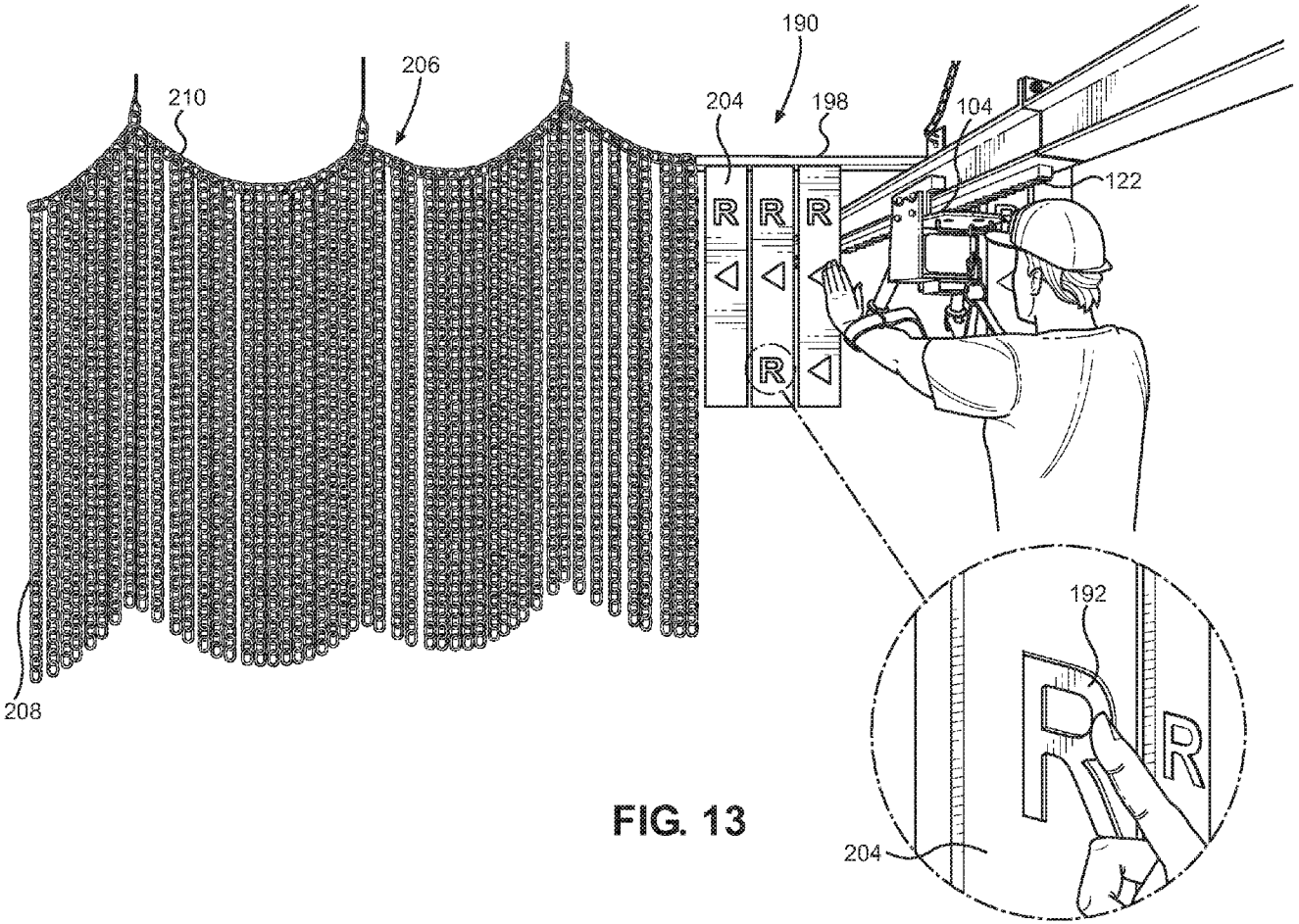
Figure 14:
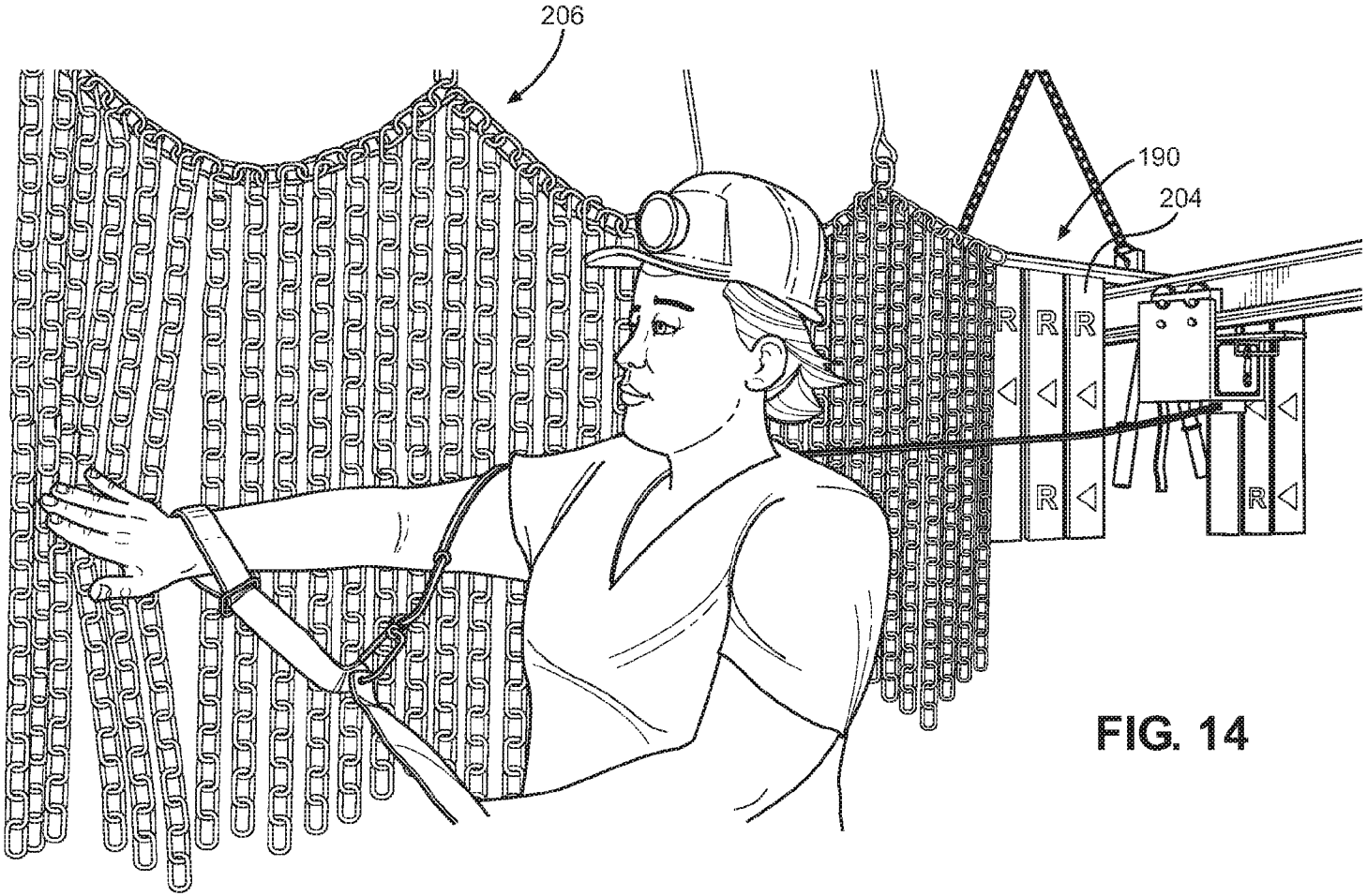
FIG. 14 illustrates a miner using a gateway curtain located at a gateway area.
Figure 15:
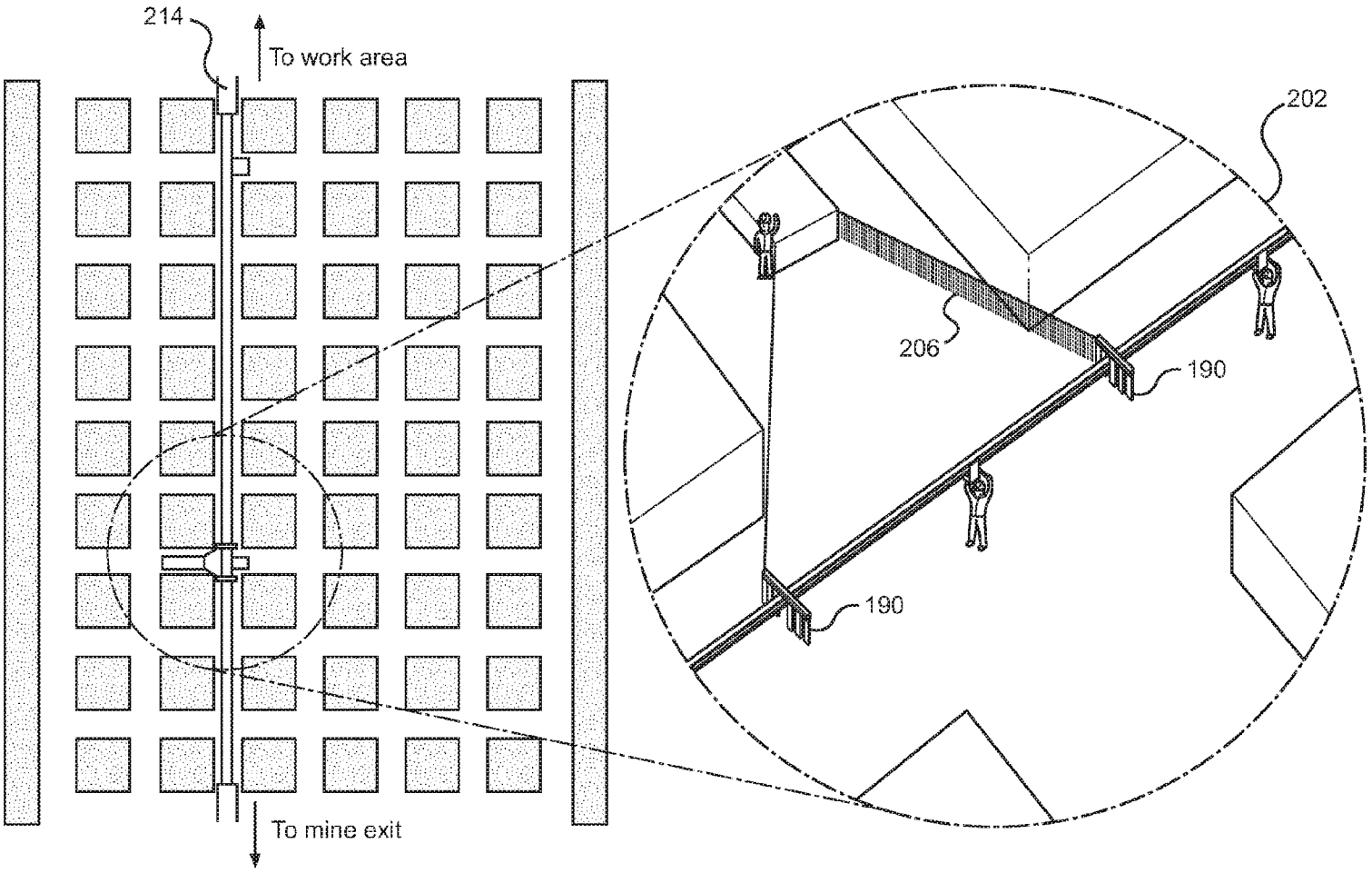
FIG. 15 illustrates a mine having an overhead rail system and a gateway area.

With reference now to FIGS. 13-15, there is provided another example of an informational sign 190, which indicates the presence of a gateway area 202, where the miner can access a rescue component, such as refuge, first aid, supplemental oxygen, an elevator shaft, etc. Preferably, the informational sign 190 will be placed at the two locations along the railway to indicate the start and the end of each gateway area 202. The gateway area 202 should be large enough so that multiple miners may park their trolleys 104 in the area if needed. The sign 190 includes a number of information panels 204 that are suspended on left and right sides of the railway from a sign hanger 198. The information panels 204 may be suspended from the sign hanger 198 using a variety of connection types. In the example shown, the panels 204 are connected using hinges. As mentioned earlier, as a miner approaches or departs from or is in the gateway area 202, the standard smooth rails 102 may be replaced with "gateway" rails that include saw tooth protrusions 122. As discussed above, these protrusions 122 interact with the clicker to produce a continual clicking sound and also vibrations. This helps to alert the miner to the presence of an upcoming gateway area 202 so that that he can slow down, if needed, and look for the gateway sign 190.

Each of the information panels 204 includes a number of characters 192 that provide information to the miner. Preferably, the characters 192 are provided in a contrasting color, texture, etc. from the information panel 204, such that the characters are easily visible. Additionally, the characters 192 may also be determined by touch. The characters 192 may be formed from embossed or debossed lettering. Alternatively, the characters 192 may be formed by punching through the information panel 204.

Like the example given above, the information included on the sign 190 provides information relating to some nearby point of interest (i.e., gateway 202), including the type of rescue component and its location. In particular example, "R" may represent refuge and the directional arrow may indicate which direction the refuge is located. However, other characters 192 may be used to indicate other information. For example, "O" may indicate supplemental oxygen, "S" may indicate an elevator shaft, "B" may indicate a refuge bunker, and "F" may indicate first aid supplies. The color of the information panels 204 or the characters 192 may vary depending on the type of gateway area 202 so that miners can quickly determine the type from a distance even when the characters 192 on the sign are not visible. For example, green colored panels 204 may indicate supplemental oxygen while orange panels may indicate refuge, etc. Furthermore, direction (i.e., left or right side) or distance of the component may be indicated on the sign 190. Also, in additional to providing information on the front of the information panel 204, additional characters 192 providing information may also be provided on the back of the panels. For example, as shown in FIG. 2, the panels may include a red reflective X to indicate that the miner is traveling away from the mine entrance/exit.

Referring again to FIGS. 13 and 14, in addition to the aforementioned signs 190, the gateway area 202 may also include gateway curtains 206, which are located near each of the signs 190 at each gateway. The purpose of the gateway curtain 206 is to guide miners from the railway to the rescue component available at the gateway area 202. As with the signs 190, gateway curtains 206 are preferably located near the rails 102 before and after the gateway area 202. The curtains may consist of a plurality of chains 208 or other similar devices (e.g., cables, etc.), which are suspended from a curtain support 210 that is hung above the miner's head, such as from the roof of the mine, and which is constructed from rods, cables, chains, etc. One reason that chains 208 are used to form the gateway curtains 206 instead of walls or nets or other similar devices is that the miner may, if he chooses to, easily walk past the chains and continue along the railway. This may be necessary, for example, if a sudden collapse or fire occurred near the gateway area and the miner was forced to move quickly away from the area. This would not be possible if the gateway area 202 was surrounded with a wall, etc. Another advantage is that the chains and curtain supports 210 are easily transportable. The curtain 206 is preferably made from steel, aluminum, fiberglass, carbon fiber, stainless, plastic and the like. In certain embodiments, the curtain 206 may be made from or covered in a reflective or fluorescent material.

In addition to simply supporting the chains 208, the purpose of the support 210 is to also guide the direction of the chain. Preferably, the curtains 206 are arrange in a cone-shaped configuration that contracts as the miner approaches the point of interest (e.g., the refuge, first aid, oxygen, elevator, etc.) and expands as the miner goes away from the point of interest. Also preferably, the curtain 206 forms a substantially enclosed area around the gateway area 202. In this way, the miner can simply follow the chains 208 using his hands to the rescue component. No matter the direction the miner travels within the gateway area 202, he will eventually arrive at the rescue component if he continues following the chains 208 in the same direction.

Figure 16:
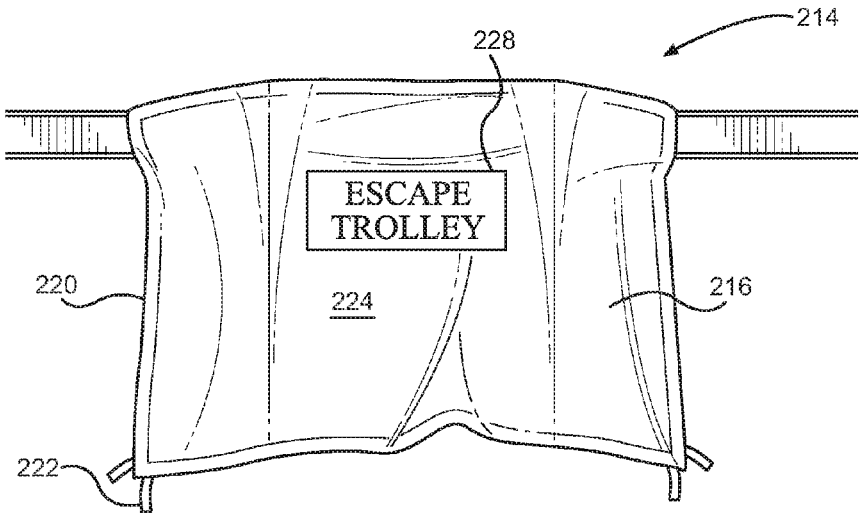
FIGS. 16-18 illustrate various aspects of a trolley storage area.
Figure 17:
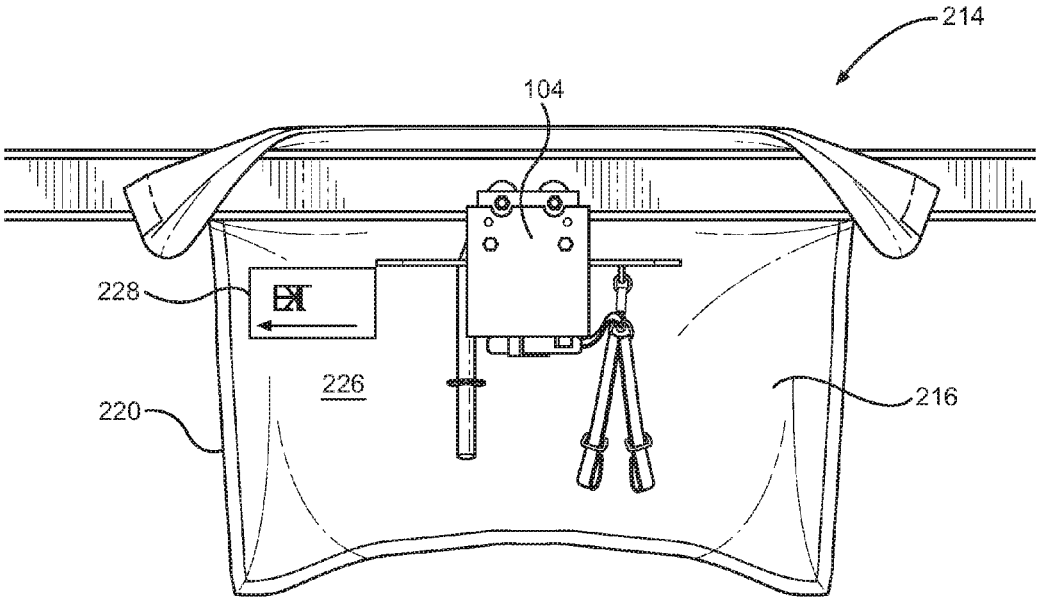
Figure 18:
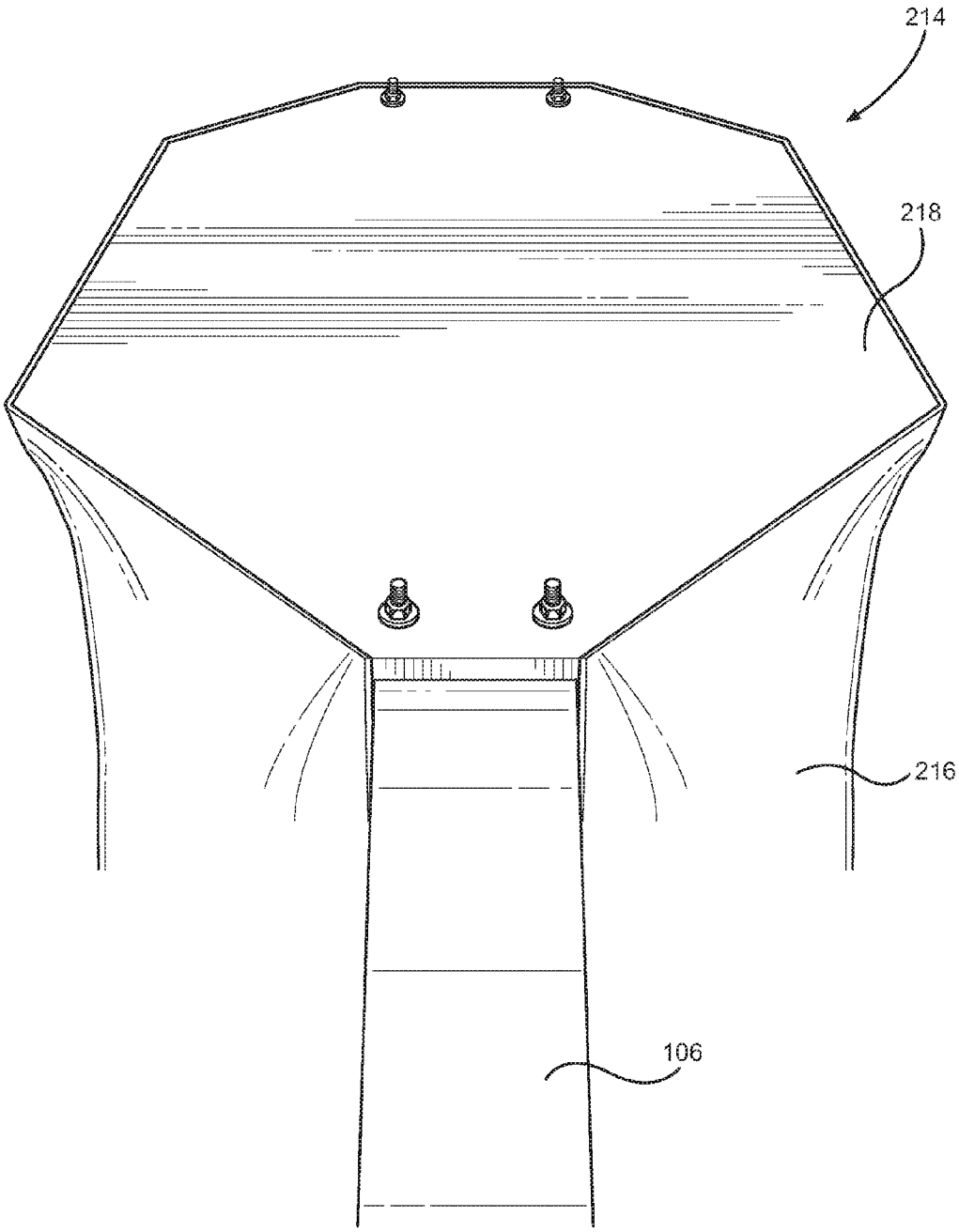

Now, with reference to FIGS. 16-18, when the trolleys 104 are not in use, they may be stored in a trolley storage area 214, which may be located at the start of the evacuation route near the working section of the mine. The trolley storage area 214 provides an area for storing a number of trolleys 104 so that they are protected from damage, are easily accessible and are out of the way. Additionally, the trolley storage area 214 serves as a staging area that clearly indicates to miners the start of the evacuation route.

The storage area 214 consists of one or more trolley curtains 216 that are hung from a protective top plate 218 and that surround one or more trolleys 104. The top plate 218, which is preferably constructed from metal, fiberglass, or other protective composite materials, provides a framework for supporting the curtains 216. This framework is designed so that the curtains 216 are able to completely envelope one or more trolleys 104. The curtains 216 may be fixedly or removably mounted to the top plate 218. The curtains are preferably constructed from a heavy-duty flexible fabric. Edges 220 of the curtain 216 may include hook and loop fastener material or metal clasps or buttons to enable the edges to be joined together. A plurality of handles 222 may be provided to assist the miners in separating the curtains 216. The curtains 216 have an outside surface 224 and an inside surface 226, which may each include information and instructions for using the rail system. For example, the outside surface 222 may include highly visible and reflective labels 228 that identify the trolley 104 and indicate where and how the curtain 116 is opened. Also, the inside surface 226 may include labels 228 that provide instructions, such as the direction of the exit.

Secondary trolleys may be stored at specified locations, such as at mandoors, for use by those miners whose work area is not near the trolley storage area 214. The secondary trolleys may clamped onto the rails 102 for use as needed. Preferably, secondary trolleys are preferably smaller and lighter than the trolleys 104 so that they can be easily lifted and handled.

In use, once a triggering event occurs, the miner first goes to the storage area 214 and uncovers the first in line trolley 104 by removing the trolley curtain 216. In a high ceiling situation, the miner places his hands through the adjustable straps 164 and then grasps the handles 146. The miner then begins to walk or run along the escape railway while continuing to grasp the handles 146. In a low ceiling situation, the miner lays on the passenger board 186 and places his hands through the adjustable straps 164. The miner than kicks to propel himself along the railway.

As the miner travels along the railway, he will encounter the gateway area 202. As explained above, this area is of vital importance to the miner, because it provides essential rescue components to support or enhance survivability in hazardous conditions. For example, the area 202 includes, but are not limited to: a refuge bunker, supplemental oxygen, first aid station, elevator, a railway merger, where two rails 102 intersect and the direction of travel may be changed if needed, and fresh water. The miner will feel the trolley 104 begin to continually vibrate a emit sound as it enters the gateway area due to the interaction of the clicker 120 with the protrusions 122. Ideally, the miner will be trained to recognize the constant vibration and sound as the signal for an upcoming gateway area 202. The miner will then reach out to the left or right of the trolley 104 to locate the first sign 190. The sign 190 informs the individual which service(s) are provided at the area 202 and their location. Once the sign 190 has been located, either visually or by touch, the miner determines if he needs to engage the services offered by the gateway area 202. If the miner determines that he do not need to engage the services offered, he may simply continue past the area 202 towards the mine exit. On the other hand, if services are needed, he will move forward within the gateway area 202 to place his trolley 104 as far forward as possible, allowing room behind his trolley for other miners.

Once the trolley 104 is parked in the gateway area 202 as possible, the miner disconnects his tether clasp 166 and moves in the direction of the rescue component (i.e., left or right), as indicated by the gateway sign 190. As the miner walks away from the trolley 104, he engages the gateway curtain 206, which will lead him to the designated safety component. The curtain 206 forms a V or cone shape and both curtains converge near the location of the safety component. Once the rescue equipment or service has be utilized at the gateway area 202, the miner returns to the trolley 104 and continues along the evacuation out of the mine. The miner will eventually reach the end of the escapeway and be able to safely exit the mine.

Figure 19:
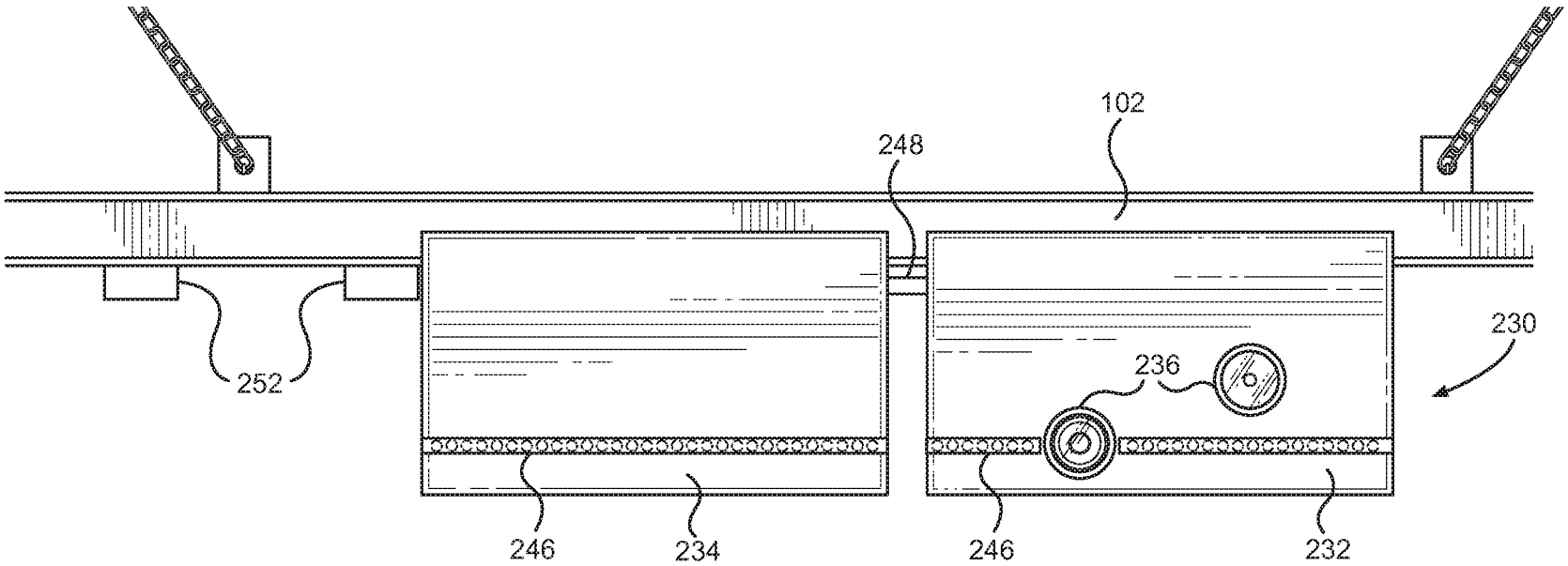
FIGS. 19-21 illustrate various aspects of a rescue pod.
Figure 20:
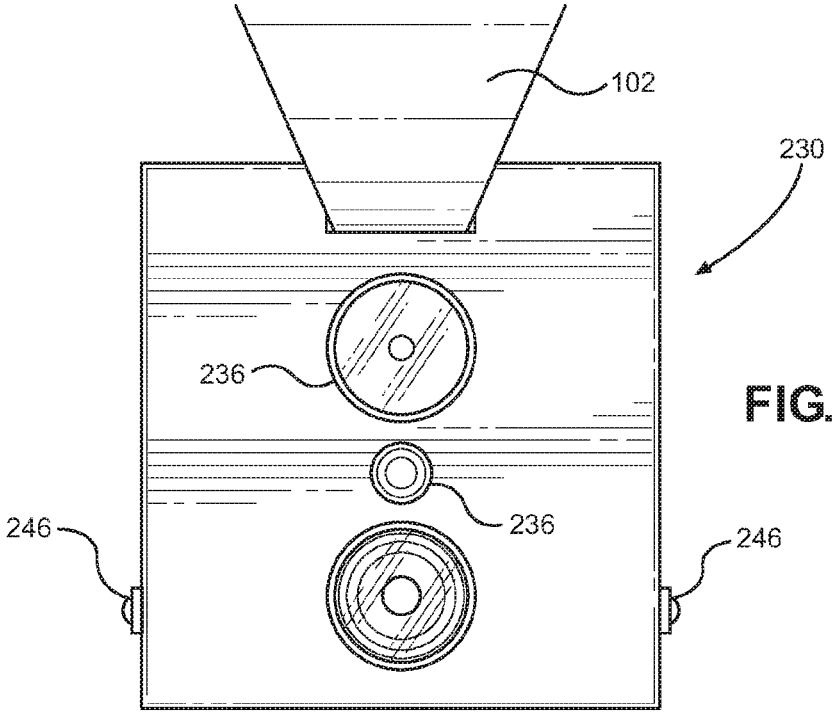
Figure 21:
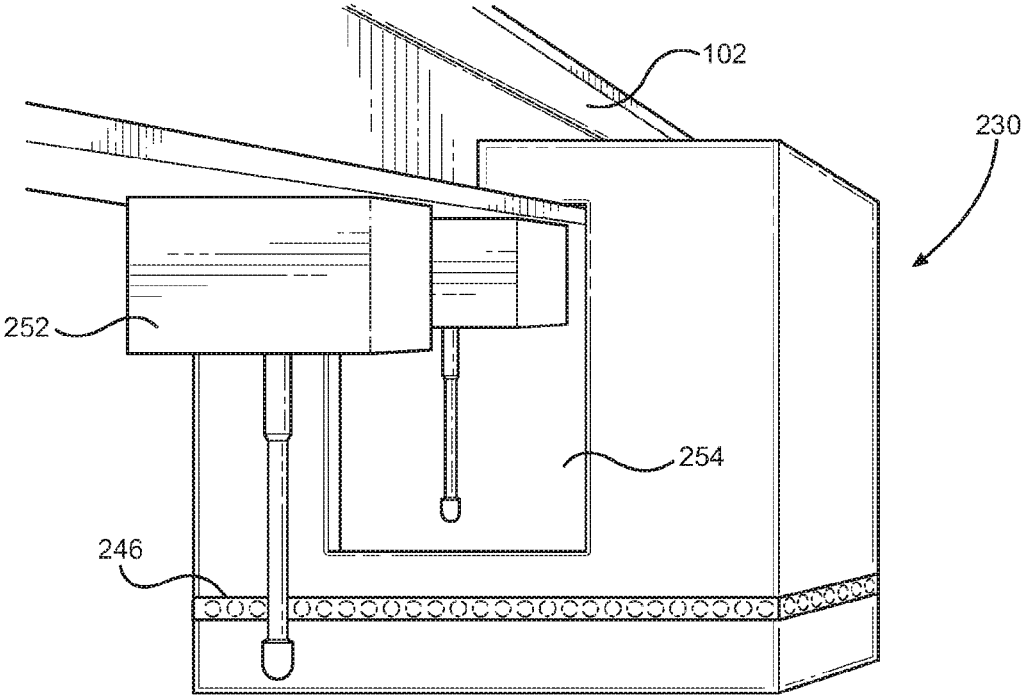

In certain situations, it may be necessary for rescue or other personnel to enter the mine after a triggering event has occurred. In those instances, as shown in FIGS. 19-21, to avoid placing others in danger, this system 100 provides a rescue pod 230 that is configured to enter the mine using the rails 102 and to communicate information and aid to those outside of the mine. For example, the rescue pod 230 could be used to communicate with miners trapped inside of the mine, search for survivors and carry supplemental oxygen or other needed items (e.g., food, water, etc.). Additionally, the rescue pod 230 will be used to investigate and explore the mine following the triggering event. The rescue pod 230 includes one or more interconnected cars that each include a heavy-duty protective shell and wheel system that mounts to the rails 102 and that propel the cars forward or backward at varying speeds.

Preferably, the rescue pod 230 is self-propelled using motor-driven wheels. The embodiment depicted comprises a front sensor pod 232 and a rear communications pod 234. The sensor pod 232 may be equipped with an array of detection tools 236, which may include high-definition video cameras, thermal imaging cameras, infrared cameras, speakers, microphones, and other environmental sensors such as air sampling devices. Additionally, the rescue pod 230 may be equipped with one or more lights, such as high-intensity LED lights 246 such that the pod is easily seen by miners inside the mine. Additionally, as the pod 230 moves, it will emit a beeping sound to alert miners to its presence. In certain embodiments, when the pod 230 is carrying additional supplies, a basket may be may be secured beneath the pod.

The communications pod 234 and the sensor pod 232 are attached via cabling 248 which transfers power and various signals between the two pods. The communications pod 234 contains communications equipment that facilitates communication between miners and those outside of the mine. In particular, the communications pod 234 may include computer units responsible for emitting electronic signals and a plurality of signal repeaters 252. Since it is often difficult to receive or transmit radio and other types of signals in underground locations, the repeaters 248 play an important role in establishing a communications link into and out of the mine. In particular, a signal broadcast from outside the mine can be transmitted from repeater 248 to repeater in a daisy chain fashion until it reaches the rescue pod 230. The signal repeaters 248 may be magnetically mounted under the bottom flange 108 to provide a quick, secure and easily removable connection point. Preferably, the communications pod 234 is able to detect when the signal from outside of the mine is weakening and, in response, deploys a repeater 252 using an onboard mechanized system in order to maintain a chain of communication. These repeaters 252 are deployed through a doorway 254 located in the back of the communications pod 234. Preferably, this doorway 254 includes a flap to keep dust and debris from entering the communications pod 234. As the communications pod 234 travels out of the mine, the repeaters 252 are retrieved and stored The foregoing description of embodiments for this invention has been presented for purposes of illustration and description. It is not intended to be exhaustive or to limit the invention to the precise form disclosed. Obvious modifications or variations are possible in light of the above teachings. The embodiments are chosen and described in an effort to provide illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A guidance and signaling system comprising:

an overhead railway in which one direction along the railway is defined as an ingress direction and an opposite direction along the railway is defined as an egress direction;

a protrusion disposed on the overhead railway;

a trolley mounted to and configured to move along the overhead railway;

a protrusion engaging member disposed on the trolley and configured to selectively engage the protrusion of the railway for preventing the trolley from moving in the ingress direction, the protrusion engaging member configured to move between a first position where the trolley can be moved past the protrusion in either the ingress direction or the egress direction and a second position where the trolley can be moved past the protrusion in the egress direction only and is stopped by the protrusion when moving in the ingress direction.

2. The guidance and signaling system of claim 1 further comprising a gripping member disposed on the trolley configured to be gripped by a user to enable the user to move the trolley along the railway.

3. The guidance and signaling system of claim 1 further comprising a plurality of consecutive protrusions disposed along the length of the railway configured to engage with the protrusion engaging member.

4. The guidance and signaling system of claim 1 wherein the overhead railway is formed by a plurality of rails joined end to end to form an intersection and wherein a protrusion is located at each intersection between rails.

5. The guidance and signaling system of claim 1 wherein the protrusion engaging member is biased to the second position by a biasing member so that, by default, the trolley can be moved past the protrusion in the egress direction only and is stopped by the protrusion when moving in the ingress direction.

6. The guidance and signaling system of claim 5 further comprising a biasing member override configured to move the protrusion engaging member from the second position to the first position so that the trolley can be moved past the protrusion in either the ingress direction or the egress direction.

7. The guidance and signaling system of claim 1 further comprising a rescue seat configured for suspension from the trolley, the seat having:

a seat body having a seat portion and a back portion;

one or more adjustable straps having connector ends configured to mount to the trolley and configured to hang beneath the railway;

sleeves in both the seat and back portions configured to receive and position the one or more straps and configured to support a miner seated in the seat.

8. The guidance and signaling system of claim 1 further comprising a passenger board having a plurality of notches formed therein and configured to receive one or more straps suspended from the trolley, the one or more straps configured to support the passenger board in a substantially horizontal orientation.

* * * * *